US005253556A

United States Patent [19]

Kelly et al.

[11] Patent Number: 5,253,556

[45] Date of Patent: Oct. 19, 1993

[54] ROD ROTATING TOOL

[75] Inventors: Michael W. Kelly, Joliet, Ill.; Glenn F. Jorgensen, Ridgewood, N.J.

[73] Assignees: Power House Tool Inc., Joliet, Ill.; JNT Technical Services Inc., Little Ferry, N.J.

[21] Appl. No.: 974,945

[22] Filed: Nov. 12, 1992

[51] Int. Cl.[5] ..... B25B 13/48

[52] U.S. Cl. ..... 81/53.2; 279/43.2; 279/43.4

[58] Field of Search ..... 81/53.2; 279/43, 43.2, 279/43.4

[56] References Cited

U.S. PATENT DOCUMENTS

| | | |
|---|---|---|
| 574,077 | 12/1896 | Sellers . |
| 603,825 | 5/1898 | Barber . |
| 801,767 | 10/1905 | Cleveland . |
| 915,184 | 3/1909 | Keirn . |
| 958,980 | 5/1910 | Thomas . |
| 1,279,349 | 9/1918 | Johnson . |
| 1,425,359 | 8/1922 | Barry . |
| 1,492,466 | 4/1924 | Jarmolowsky . |
| 1,498,040 | 6/1924 | Johnson . |
| 1,499,701 | 7/1924 | Skeel . |
| 1,514,357 | 11/1924 | Whelan . |
| 1,566,691 | 12/1925 | Perry . |
| 1,583,554 | 5/1926 | Hoover . |
| 1,694,628 | 12/1928 | Sauveur . |
| 1,815,500 | 7/1931 | Doan . |
| 1,818,626 | 8/1931 | Johnston . |
| 2,086,167 | 7/1937 | Lamb . |
| 2,390,034 | 11/1945 | Walker . |
| 2,391,624 | 12/1945 | Heuer . |
| 2,497,214 | 2/1950 | Dreyer . |
| 2,701,489 | 2/1955 | Osborn . |
| 2,798,392 | 7/1957 | Randolph . |
| 3,104,569 | 9/1963 | Davis et al. . |
| 3,529,497 | 9/1970 | Brooks . |
| 4,603,605 | 8/1986 | Miller . |
| 4,651,596 | 3/1987 | Rachanski . |
| 4,777,850 | 10/1988 | Polonsky . |
| 5,152,195 | 10/1992 | Merrick . |

*Primary Examiner*—James G. Smith

*Attorney, Agent, or Firm*—Hill, Steadman & Simpson

[57] ABSTRACT

A tool for rotating a rod is provided which is formed of three sleeves. A first sleeve has an internal opening size to receive the rod and has an outwardly flared, slitted end which is placed over the rod. A second sleeve slips on to the first sleeve and engages against the flared end. A third sleeve slips over the first sleeve and engages against the second sleeve and is locked axially to the first sleeve. The third sleeve carries longitudinally extendable members which can be used to press against the second sleeve pushing it along the flared portion of the first sleeve to collapse the end of the first sleeve engaging the rod to increase the gripping force of the first sleeve with the rod. The first sleeve has an external contour for receiving a torque applying device, such as a wrench, so that the first sleeve can be rotated, thus rotating the rod.

20 Claims, 1 Drawing Sheet

ROD ROTATING TOOL

BACKGROUND OF THE INVENTION

The present invention relates to tools and in particular a tool for rotating a rod or post, such as a stud.

A threaded rod, such as a stud, oftentimes presents an assembly or disassembly problem in that there generally is no gripping surface on such a fastener against which to apply a torque force to rotate the fastener. This is particularly true when there are very close tolerances between the threaded fastener and the threaded opening into which it is threaded, requiring a high torque level for rotation of the fastener relative to material into which it is being inserted or from which it is being removed. Occasionally threaded rods, or studs, are placed into working environments wherein corrosive liquids or gases are present causing a locking or seizing to occur between the stud and the surrounding material, increasing the difficulty of removal of the stud.

Various mechanisms have been provided for assisting in the stud removal or inserting process. For example, U.S. Pat. No. 4,932,292 discloses a device which could be used to remove a stud. This device employs an arrangement of loose jaws which engage against ramp surfaces to selectively move the jaws radially inwardly to grip a central post when the tool is rotated in one rotational direction. Rotation in an opposite direction will cause the jaws to loosen from the post. Therefore, such a device can be used only to rotate the post in one rotational direction.

It would be an advance in the art if there were provided an easy to use tool for readily rotating a rod in either rotational direction.

SUMMARY OF THE INVENTION

A tool in accordance with the principles of the present invention comprises three sleeve members. A first sleeve member has an internal passage for receiving the rod or stud. The passage may or may not extend entirely through the first sleeve. The first sleeve has a drive arrangement at a first end for engagement by a torque applying tool such as a wrench. A second end of the sleeve has an outer surface flared outwardly and has a plurality of slits extending axially toward the first end. This sleeve is to be slipped on to or threaded on to the rod which is to be rotated. A second sleeve has an internal diameter larger than an external threaded portion of the first sleeve, but less than the outwardly flared diameter at the first sleeve's second end. This second sleeve, which can be in the form of a ring, is slipped on to the first sleeve until it engages against the flared portion of the first sleeve.

A third sleeve preferably has an internal thread which engages with the external thread of the first sleeve. The third sleeve is threaded down towards the second sleeve. The third sleeve also carries longitudinally extendable members which can be in the form of jack screws which engage against the second sleeve. Once the second sleeve has been threaded, hand tight, to where it engages the second sleeve, the extendable members are then sequentially extended to press against the second sleeve causing it to slide along the flared portion of the first sleeve, resulting in the first sleeve being pressed inwardly which is accommodated by the longitudinal slits. The inward pressing of the first sleeve against the rod greatly increases the frictional engagement between the first sleeve and the rod. Thus when the first sleeve is rotatably driven, the rod rotates as well. The interior surface of the first sleeve can either be threaded to match the thread of the rod, or can have some other friction enhancing contour, such as a series of longitudinal splines or knurls to enhance the frictional engagement between the first sleeve and the rod.

DETAILED DESCRIPTION OF THE PREFERRED EMBODIMENTS

Figure 1:
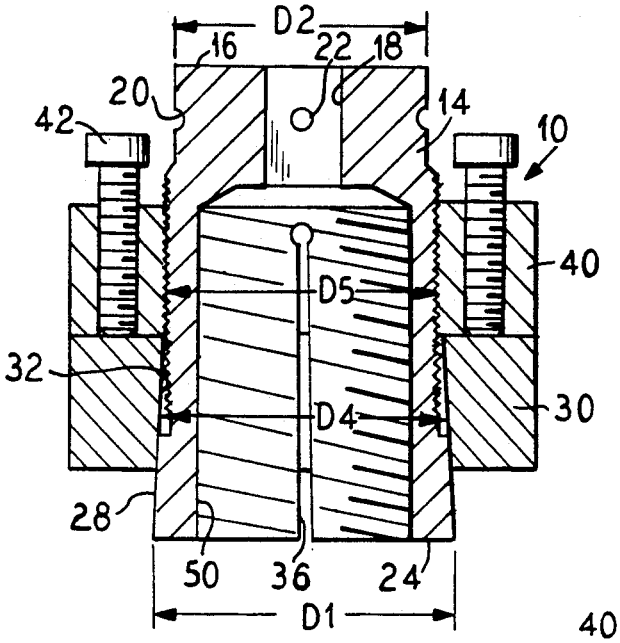
FIG. 1 is a side sectional view of a tool embodying the principles of the present invention with the third sleeve engaging the second sleeve.

In FIGS. 1–4 a tool is illustrated generally at 10 which is useful in applying a rotational torque to a post or rod member 12 (FIG. 2), preferably a threaded rod such as a stud. The tool 10 is comprised of a first sleeve member or collet 14 which is generally cylindrical. The sleeve member 14 has a first end 16 which has a surface configuration adapted to receive a torque applying driving type tool. In the embodiment illustrated in the drawings, a square opening 18 is provided for receipt of a square drive impact wrench. Such a wrench typically has an arrangement for locking on to a tool which requires the use of a groove 20 and apertures 22 for receipt of a locking pin. Many other types of surface configurations can be utilized including a hexagonal shaped outer periphery, a spline drive shape, a castellated drive shape, etc.

The first sleeve 14 has a second end 24 with an outside diameter $D_1$ greater than a diameter $D_2$ of the first end. A central portion 26 of the first sleeve 14 has a diameter $D_3$ which also is less than the diameter $D_1$ of the second end 24. In the preferred embodiment illustrated in FIGS. 1 and 2, the central portion 26 has an external thread thereon. The thread terminates prior to the second end 24. A portion 28 of the first sleeve 14 extending from the threaded portion 26 to the second end 24 is flared outwardly and downwardly (as illustrated) beginning at a step 29 thus providing the increased diameter $D_1$ at the second end 24. The angle of the flare is preferably in the range of 3°–6°. The first sleeve 14 has a plurality of longitudinal slits 36 therein which extend from the second end 24 toward the first end 16, but stop short of the first end. Preferably the slits extend along 60–80% of the length of the first sleeve.

A second sleeve member 30 is provided which has an inside diameter $D_4$ which is greater than diameters $D_2$ and $D_3$, but less than diameter $D_1$. The second sleeve 30 can have an axial length shorter than its diameter, thus giving it the appearance of a ring.

Figure 5:
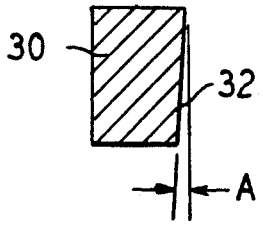
FIG. 5 is a side sectional view of the split second sleeve showing the angle of the interior diameter.
Figure 3:
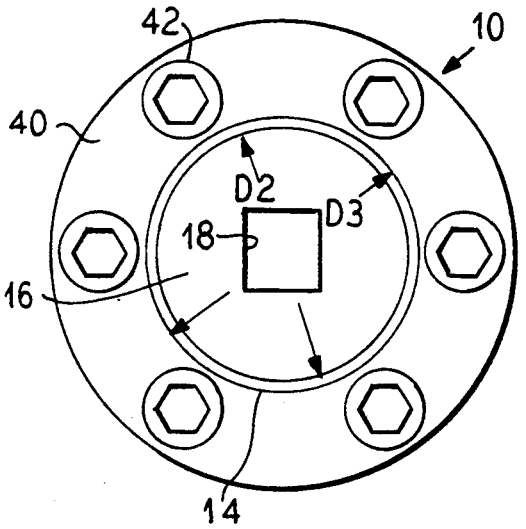
FIG. 3 is a top end elevational view of the tool in FIG. 1.

The second sleeve 30 is positioned on the first sleeve 14 by sliding the second sleeve along the first sleeve until the inside diameter $D_4$ of the second sleeve 30 engages against the flared portion 28 of the first sleeve 14. In a preferred embodiment, as best illustrated in FIG. 5, an inside wall 32 of the second sleeve 30 has an angle A which is the same angle as the flare of portion 28 in order to allow surface contact between sleeve 30 and sleeve 14 and to avoid point contact therebetween. It is also preferred to provide a lubricant, such as graphite, to the flared portion 28 to reduce the sliding friction between the first 14 and second 30 sleeves.

A third sleeve member 40 has an internal diameter $D_5$ which is essentially identical to or slightly greater than diameter $D_3$. In the preferred embodiment, the internal diameter $D_5$ of the third sleeve 40 is threaded to match the thread on the threaded portion 26 of the first sleeve until it engages the second sleeve. Thus, the third sleeve, which may be in the form of a ring, can be threaded on to the exterior of the first sleeve. Thus, when the third sleeve 40 is positioned on the first sleeve 14, it is prevented from moving axially relative to the first sleeve. Although a threaded connection is illustrated, any other type of mechanical arrangement can be utilized to secure the third sleeve 40 axially relative to the first sleeve 14, once the third sleeve is put into place. Threaded fasteners, clamps, set screws, engaging flanges, etc. could be used. If a threaded engagement is used, again, a lubricant such as graphite should be applied to the mating surfaces of the first and third sleeves.

The third sleeve 40 carries on it one or more longitudinally extendable members 42. In the preferred embodiment illustrated, the extendable members 42, may be in the form of jack bolts as described in U.S. Pat. No. Re 33,490, incorporated herein by reference. Preferably the bolts 42 are sequentially tightened which causes them to press against the second sleeve 30 to press and slide it downwardly against the flare portion 28. Again, although jack bolts are illustrated as the extendable members, other mechanisms could be used including levers, rack and pinion devices, ratchet devices, etc.

Due to the provision of the slits 36 in the first sleeve 14, the first sleeve will be moved radially inwardly as the second sleeve 30 moves downwardly along the flared surface, thus causing a gripping engagement between an inner surface 50 of the first sleeve 14 and the rod 12. Once a sufficiently tight engagement between the first sleeve 14 and the rod 12 is achieved, a tool can be applied to the first sleeve 14 to apply a torque force to cause the first sleeve 14 and thus the rod 12 to rotate. Rotation of the rod 12 can thus be effected in either direction permitting this tool to be used in loosening or tightening such a threaded rod.

Figure 2:
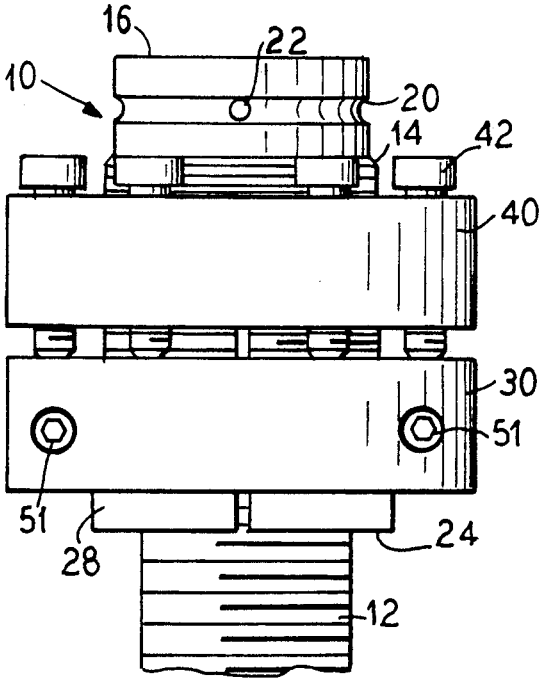
FIG. 2 is a side elevational view of the tool shown in FIG. 1 with the second sleeve being pressed onto the flared portion of the first sleeve.
Figure 4:
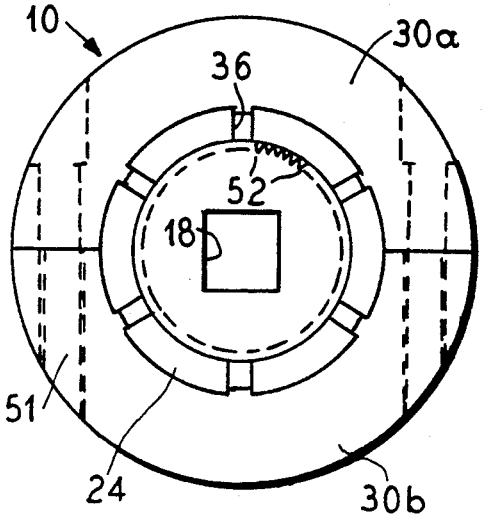
FIG. 4 is a bottom end elevational view of an alternate embodiment of the tool shown in FIG. 1.

To enable the second sleeve 30 to be easily removed from the flared end 28 of the first sleeve 14, as an option the second sleeve can be formed as either a split ring or as two half rings 30*a*, 30*b* (FIGS. 2, 4). One or two lateral screws 51 can be used to initially hold the second sleeve 30 in a closed position. To facilitate removal, one or both of the screws 51 can be loosened to release the gripping force being applied by the second sleeve 30.

The inner surface 50 of the first sleeve 14 is provided with a friction enhancing contour which may be a threaded surface as shown in FIG. 2 to match with threads on the rod 12, or could be of some other contour such as a series of splines 52 as illustrated in FIG. 4.

As is apparent from the foregoing specification, the invention is susceptible of being embodied with various alternations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A tool for adjusting the axial position of a threaded post comprising:

a collet having a first end with a surface configuration adapted to receive a torque applying driver, a second end outwardly flared with a largest diameter at said second end and having a plurality of longitudinal slits extending from said second end and stopping short of said first end, an externally threaded section between said first and second ends, and an internal opening sized to receive said post with a minimum amount of play, said internal opening having a surface with a friction enhancing contour;

a ring having an internal diameter slightly larger than a diameter of said threaded section and smaller than said outwardly flared diameter;

a sleeve having an interanl thread to match with said external thread, said sleeve having a plurality of axially extending extendable members thereon;

wherein said ring is carried on said collet between said threaded portion and said flared portion and said sleeve is threaded on said threaded portion until said sleeve engages with said ring, and said members are extended to push said ring onto said flared portion to cause said second end of said collet to collapse and grippingly engage said post.

2. A tool according to claim 1, wherein said axially extending extendable members comprise jack screws threadingly received in said sleeve.

3. A tool according to claim 1, wherein said friction enhancing contour comprises a thread to match with an external thread on said post.

4. A tool according to claim 1, wherein said friction enhancing contour comprises a series of longitudinal knurls.

5. A tool for use in rotating a rod comprising:

a first sleeve member having a surface configuration adapted to receive a torque applying driver, a first and second axial end, said second end having a portion which is outwardly flared with a largest diameter at said second end and having a plurality of longitudinal slits extending from said second end and stopping short of said first end, and an internal opening leading from said second end and sized to receive said rod with a minimum amount of play;

a second sleeve member having an internal diameter greater than said first end and smaller than said outwardly flared diameter;

a third sleeve having an interanl diameter slightly greater than said first end, said third sleeve carrying a plurality of longitudinally extendable members thereon; and means engageable between said first sleeve and said third sleeve to selectively retain said third sleeve on said first sleeve in a fixed axial position;

wherein said second sleeve is carried on said first sleeve adjacent to said flared portion and said third sleeve is carried on said first sleeve adjacent to said second sleeve, on the side closest to said first end and said longitudinally extendable members are brought into engagement with said second sleeve, and said members are extended to push said second sleeve onto said flared portion to cause said second end of said first sleeve to move radially inwardly and grippingly engage said post.

6. A tool according to claim 5 wherein said means for retaining said first and third sleeves in a fixed axial position comprises said first sleeve including a section having an external thread thereon between said first end and said flared portion and said third sleeve having an internal thread matching with said external thread.

7. A tool according to claim 5, wherein said longitudinally extendable members comprise jack screws carried on said second sleeve.

8. A tool according to claim 5, wherein said internal opening comprises a blind hole.

9. A tool according to claim 5, wherein said second sleeve member comprises a split ring held in a closed position by a laterally extending fastening means.

10. A tool for axially rotating a rod comprising:

a first sleeve member having a first end with a surface configuration adapted to receive a torque applying driver, a second end having a portion which is outwardly flared with a largest diameter at said second end and having a plurality of longitudinal slits extending from said second end and stopping short of said first end, and an internal opening leading from said second end and sized to receive said rod with a minimum amount of play;

a second sleeve member having an internal diameter slightly smaller than said outwardly flared diameter;

a third sleeve having an internal diameter slightly greater than said first end, said third sleeve carrying a plurality of longitudinally extendable members thereon; and means engageable between said first sleeve and said third sleeve to selectively retain said third sleeve on said first sleeve in a fixed axial position;

wherein said second sleeve is carried on said first sleeve adjacent to said flared portion, said third sleeve is carried on said first sleeve adjacent to said second sleeve, on the side closest to said first end, said longitudinally extendable members are brought into engagement with said second sleeve, and said members are extended to push said second sleeve onto said flared portion to cause said second end of said first sleeve to move radially inwardly and grippingly engage said post.

11. A tool according to claim 10, wherein said first end is configured to receive the driving end of a square drive impact wrench.

12. A tool according to claim 10, wherein said outward flare at said second end is in the range of 3° to 6°.

13. A tool according to claim 10, wherein said longitudinal slits extend along a length of 60 to 80% of the length of said first sleeve.

14. A tool according to claim 10, wherein six longitudinal slits are provided in said first sleeve.

15. A tool according to claim 10, wherein said means for holding said first and third sleeves in a fixed axial position comprises said first sleeve including a section having an external thread thereon between said first end and said flared portion and said third sleeve having an internal thread matching with said external thread.

16. A tool according to claim 10, wherein said first sleeve internal opening has a surface with a friction enhancing contour.

17. A tool according to claim 16, wherein said contour comprises a thread to match with an external thread on said rod.

18. A tool according to claim 16, wherein said contour comprises a series of longitudinal splines.

19. A tool according to claim 16, wherein said longitudinally extendable members comprise jack screws carried on said second sleeve.

20. A tool according to claim 16, wherein said internal opening comprises a blind hole.

* * * * *